US011415020B2

(12) United States Patent
Vu et al.

(10) Patent No.: US 11,415,020 B2
(45) Date of Patent: Aug. 16, 2022

(54) GAS TURBINE ENGINE FLOWPATH COMPONENT INCLUDING VECTORED COOLING FLOW HOLES

(71) Applicant: United Technologies Corporation, Farmington, CT (US)

(72) Inventors: Ky H. Vu, East Hartford, CT (US); Brian R. Pelletier, Berwick, ME (US)

(73) Assignee: Raytheon Technologies Corporation, Farmington, CT (US)

( * ) Notice: Subject to any disclaimer, the term of this patent is extended or adjusted under 35 U.S.C. 154(b) by 181 days.

(21) Appl. No.: 16/702,887

(22) Filed: Dec. 4, 2019

(65) Prior Publication Data

US 2021/0172335 A1 Jun. 10, 2021

(51) Int. Cl.

| | |
|---|---|
| ***F01D 25/12*** | (2006.01) |
| ***F01D 11/24*** | (2006.01) |
| *F01D 9/04* | (2006.01) |

(52) U.S. Cl.

CPC ..... *F01D 25/12* (2013.01); *F01D 11/24* (2013.01); *F01D 9/041* (2013.01); *F05D 2220/323* (2013.01); *F05D 2240/11* (2013.01); *F05D 2240/12* (2013.01); *F05D 2240/81* (2013.01); *F05D 2260/201* (2013.01); *F05D 2260/202* (2013.01)

(58) Field of Classification Search

CPC ..... F01D 9/041; F01D 25/12; F01D 11/24; F05D 2240/81

See application file for complete search history.

(56) References Cited

U.S. PATENT DOCUMENTS

| | | | | |
|---|---|---|---|---|
| 4,311,431 | A | 1/1982 | Barbeau | |
| 4,522,557 | A | 6/1985 | Bouiller et al. | |
| 6,887,033 | B1 * | 5/2005 | Phillips | F01D 25/12 415/115 |
| 7,246,989 | B2 | 7/2007 | Glasspoole et al. | |
| 10,408,071 | B2 | 9/2019 | Lewis et al. | |
| 10,704,419 | B2 * | 7/2020 | Bassery | F01D 5/189 |
| 2005/0100437 | A1 * | 5/2005 | Phillips | F01D 5/186 415/115 |
| 2006/0123794 | A1 | 6/2006 | Glasspoole et al. | |
| 2008/0131260 | A1 | 6/2008 | Lee et al. | |
| 2016/0230577 | A1 * | 8/2016 | Lewis | F01D 9/041 |
| 2020/0025037 | A1 * | 1/2020 | Bassery | F01D 9/065 |

FOREIGN PATENT DOCUMENTS

| | | |
|---|---|---|
| EP | 3396112 | 10/2018 |
| EP | 3412869 | 12/2018 |

OTHER PUBLICATIONS

European Search Report for European Patent Application No. 20210931.0 dated Apr. 8, 2021.

* cited by examiner

*Primary Examiner* — Eldon T Brockman

(74) *Attorney, Agent, or Firm* — Carlson, Gaskey & Olds, P.C.

(57) ABSTRACT

A gas turbine engine includes a primary flowpath connecting a compressor section, a combustor section and a turbine section. The turbine section includes a stage vane having a radially outward platform and a vane extending into the primary flowpath. The platform includes a cooling plenum. At least one retaining feature extends radially outward from the platform. At least one vectored cooling hole is disposed in the retaining feature and is configured to direct cooling air from the plenum to an adjacent gaspath component.

20 Claims, 4 Drawing Sheets

GAS TURBINE ENGINE FLOWPATH COMPONENT INCLUDING VECTORED COOLING FLOW HOLES

STATEMENT REGARDING FEDERALLY SPONSORED RESEARCH OR DEVELOPMENT

This invention was made with Government support awarded by the United States. The Government has certain rights in this invention.

TECHNICAL FIELD

The present disclosure relates generally to gas turbine engine flowpath components, and more specifically to a flowpath component including vectored cooling flow holes.

BACKGROUND

Gas turbine engines, such as those utilized in commercial and military aircraft, include a compressor section that compresses air, a combustor section in which the compressed air is mixed with a fuel and ignited, and a turbine section across which the resultant combustion products are expanded. The expansion of the combustion products drives the turbine section to rotate. As the turbine section is connected to the compressor section via a shaft, the rotation of the turbine section further drives the compressor section to rotate. In some examples, a fan is also connected to the shaft and is driven to rotate via rotation of the turbine as well.

During operation of the gas turbine engine, components exposed to the turbine section flowpath are subject to extreme thermal loads. In order to prevent or minimize damage and wear resulting from the exposure to thermal loads, gaspath components are in some examples cooled using cooling air passed through the gaspath components along a cooling flowpath. Once spent, the cooling air is either expelled into a primary flowpath or passed to an adjacent component to provide additional cooling.

SUMMARY OF THE INVENTION

In one example, a gaspath component includes a platform including a cooling plenum, at least one retaining feature extending from the platform, and at least one vectored holes disposed in the at least one retaining feature and connected to the cooling plenum.

In another example of the above gaspath component, each vectored hole defines a corresponding axis, and each corresponding axis is aligned with each other corresponding axis.

In another example of any of the above gaspath components, the at least one vectored hole includes at least two vectored holes defining converging axis.

In another example of any of the above gaspath components, all vectored holes in the at least one vectored hole defines a converging axis.

In another example of any of the above gaspath components, the at least one vectored hole includes a plurality of vectored holes and each hole in the plurality of vectored holes is identical to each other hole in the plurality of vectored holes.

In another example of any of the above gaspath components, the at least one vectored hole includes a plurality of vectored holes and each hole in the plurality of vectored hole has an identical cross sectional area.

Another example of any of the above gaspath components includes a vane extending from the platform, and wherein a portion of cooling air received in the cooling plenum is directed to a cooling air flowpath within the vane.

In another example of any of the above gaspath components, the at least one retaining feature includes a downstream retention hook, relative to an expected flow direction of an engine including the gaspath component, and an upstream retention hook.

In another example of any of the above gaspath components, the at least one vectored hole has a length to cross sectional area ratio of at least 2.

In another example of any of the above gaspath components, the at least one vectored hole includes a plurality of vectored holes and each vectored hole in the plurality of vectored holes is arranged in a linear configuration.

In another example of any of the above gaspath components, the at least one vectored hole includes a plurality of vectored holes and the plurality of vectored holes are unevenly distributed.

In one example, a method for providing cooling air to a gaspath component includes providing air to a plenum of a first gaspath component, passing cooling air from the plenum to a second gaspath component axially adjacent the first gaspath component through at least one vectored cooling hole, the at least one vectored cooling hole imparting directionality on the cooling air.

Another example of the above method further includes directing air from at least a portion of the at least one vectored cooling hole to a single location of the second gaspath component.

In another example of any of the above methods, the at least one vectored cooling hole includes at least two vectored cooling holes defining a converging axis.

In another example of any of the above methods, passing cooling air from the plenum to the second gaspath component comprises directing the cooling air around at least one of an intervening structure and a front feature of the second gaspath component.

In another example of any of the above methods. the first gaspath component is a vane and the second gaspath component is a blade outer air seal.

In another example of any of the above methods, the at least one vectored hole includes a plurality of vectored holes and each of the vectored cooling holes in the plurality of vectored cooling holes imparts identical directionality on the cooling air.

In one example, a gas turbine engine includes a primary flowpath connecting a compressor section, a combustor section and a turbine section, the turbine section including stage vane having a radially outward platform and a vane extending into the primary flowpath, the platform including a cooling plenum, at least one retaining feature extending radially outward from the platform, and at least one vectored cooling holes disposed in the retaining feature and configured to direct cooling air from the plenum to an adjacent gaspath component.

In another example of the above gas turbine engine, wherein the adjacent gaspath component is a blade outer air seal.

In another example of either of the above gas turbine engines, the at least one vectored hole has a length to cross sectional area ratio of at least 2. These and other features of the present invention can be best understood from the following specification and drawings, the following of which is a brief description.

DETAILED DESCRIPTION

Figure 1:
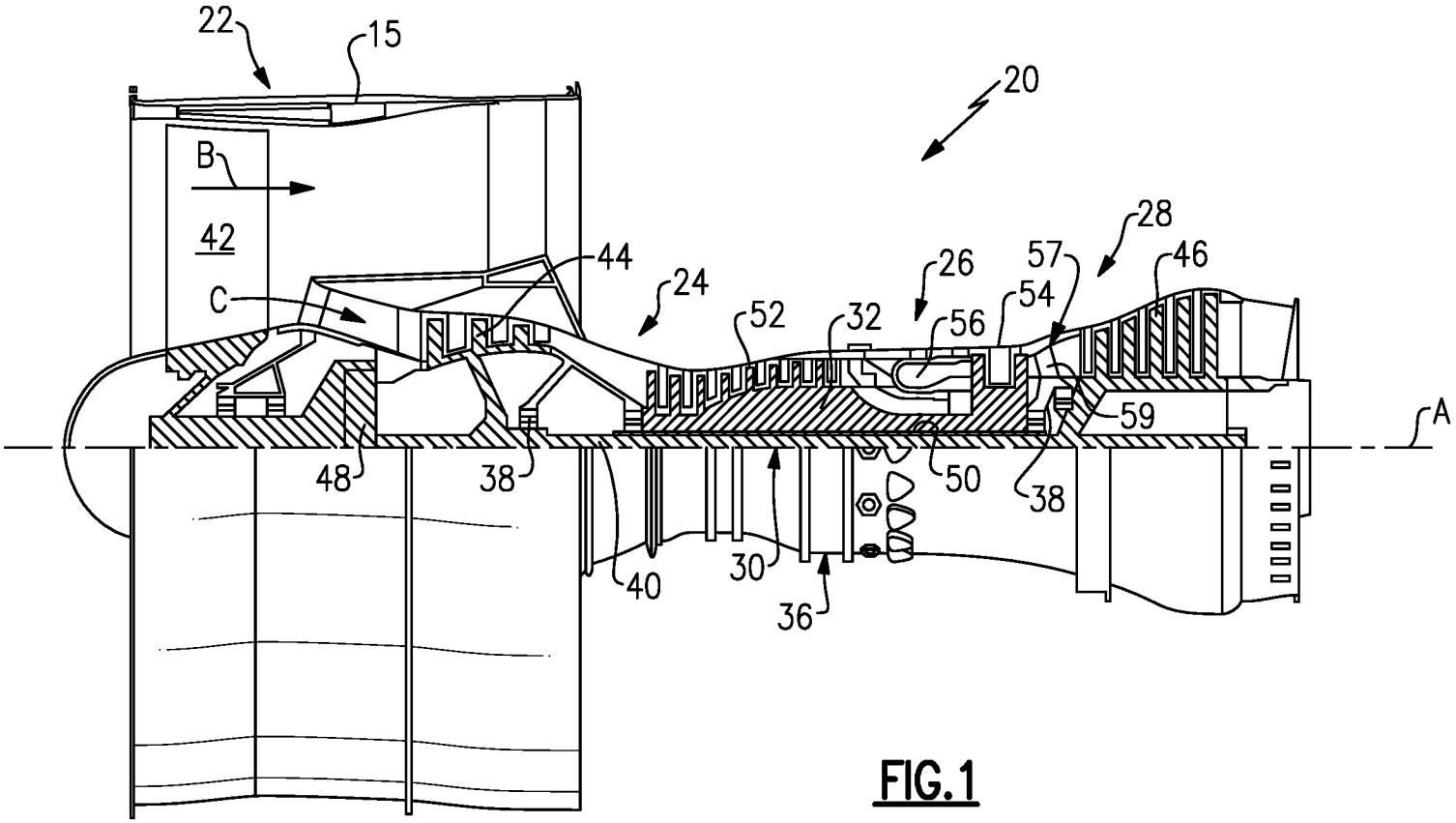
FIG. 1 illustrates a high level schematic view of an exemplary gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 drives air along a bypass flow path B in a bypass duct defined within a nacelle 15, and also drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second (350.5 meters/second).

Figure 2:
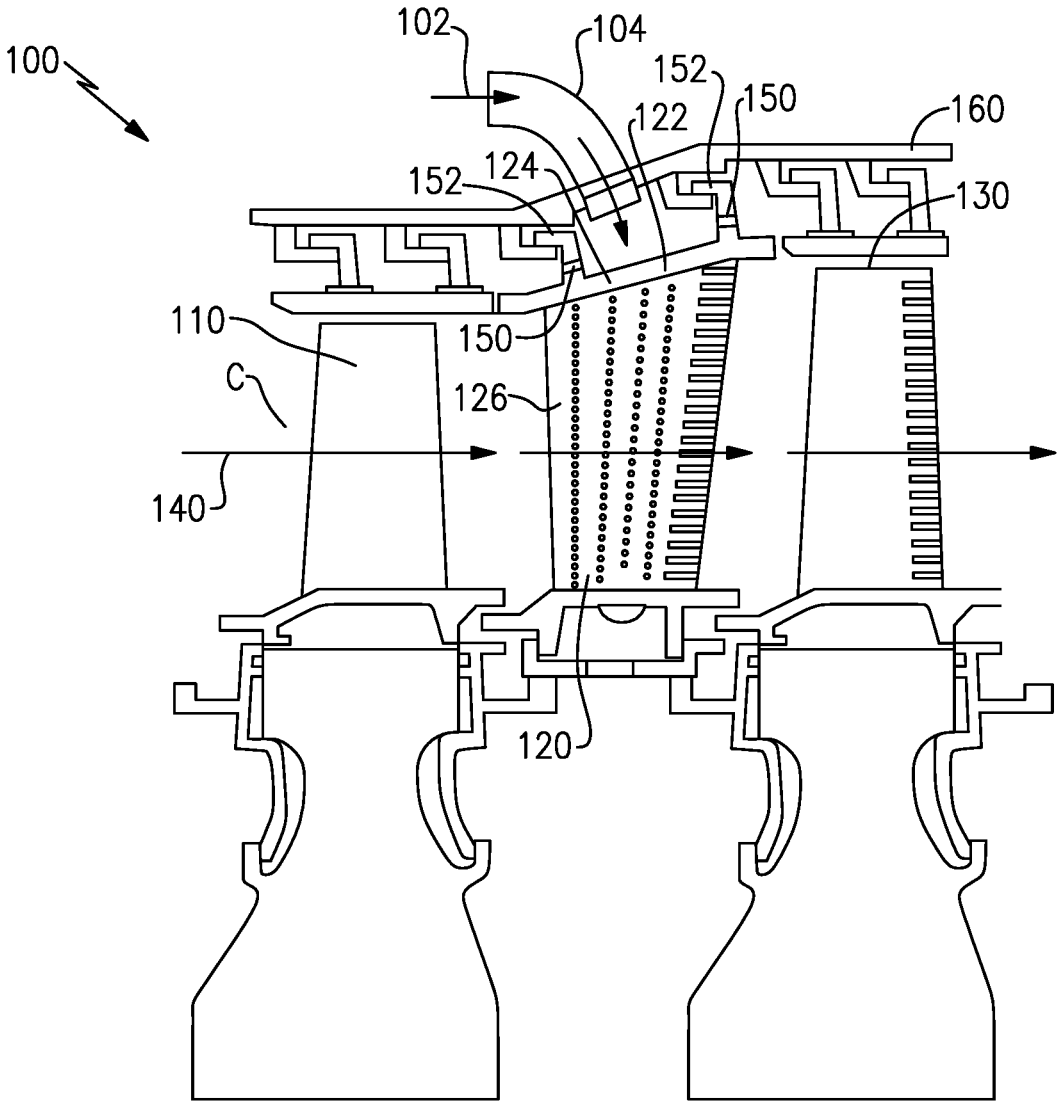
FIG. 2 schematically illustrates a portion of the turbine section of FIG. 1.

With continued reference to FIG. 1, FIG. 2 schematically illustrates a partial view 100 of the turbine section 28. Illustrated within the partial view 100 is a first stage rotor 110, a second stage vane 120, and a second stage rotor 130. Each of the rotors 110, 130 spans a majority of the flowpath C through which a primary gas flow 140 passes, and the vane 120 extends the full span. In order to cool the vane 120, and thereby prevent or minimize damage and wear due to thermal cycling, cooling air 102 is provided to a plenum 122 in a radially outward platform 124 of the vane 120 via a cooling tube 104. The cooling air 102 can be sourced from any appropriate cooling air source, and can be connected to the vane 120 via any existing connection system.

A portion of the cooling air 102 entering the plenum 122 is passed into an airfoil portion 126 of the vane 120 and used to cool the airfoil portion 126. Spent cooling air from the airfoil portion 126 is expelled into the flowpath C, and exhausted from the engine along with the primary gas flow 140. Another portion of the cooing air entering the plenum 122 is passed to adjacent gaspath components through a set of openings 150 in retaining features 152. The illustrated retaining features 152 include retaining hooks that interface with an engine static structure 160, such as a housing, and maintain the positioning of the vane 120. While illustrated herein as a vane, it is appreciated that the disclosure can be applied to any gaspath component and is not limited to the exemplary vane configuration.

In some examples it is desirable to direct the cooling air from the plenum 122 to a specific portion of the adjacent gaspath component, such as a hot spot. In other examples, it is desirable to direct the air around intervening elements, such as retention hooks and engine housing features. To facilitate these requirements, the openings 150 are made up of multiple vectored cooling holes arranged in a predetermined pattern. The predetermined pattern utilizes directionality imparted by the vectored cooling holes 150 to direct the cooling air to specific locations on, or regions of, the adjacent component.

As used herein, a vectored cooling hole is a cooling hole having a length to diameter ratio sufficient to direct air passing through the hole 150 in a specific direction. By way of example, this ratio sized to ensure effective flow direction, In one example, the ratio is at least 2 in a vane according to FIG. 2. The specific pattern and orientations of the vectored cooling holes making up a given opening 150 varies depending on the physical structures of the engine in which component is to be incorporated, and is based on the cooling requirements of the engine.

By vectoring the cooling holes, the air is provided with directions other than axial (relative to the gas turbine engine center line A on FIG. 1), thereby optimizing a cooling scheme of the adjacent gaspath components. Providing the air with a specific flow direction is referred to as imparting directionality on the air. Further, in cases where there is a differing number of vanes and adjacent components resulting periodic or non-periodic pattern, the vectored holes provide the same amount of cooling air supply to the adjacent components as a simple slot, and direct the cooling air around front features of the adjacent component so that the cooling air can reach the entirety of the adjacent component.

Figure 3:
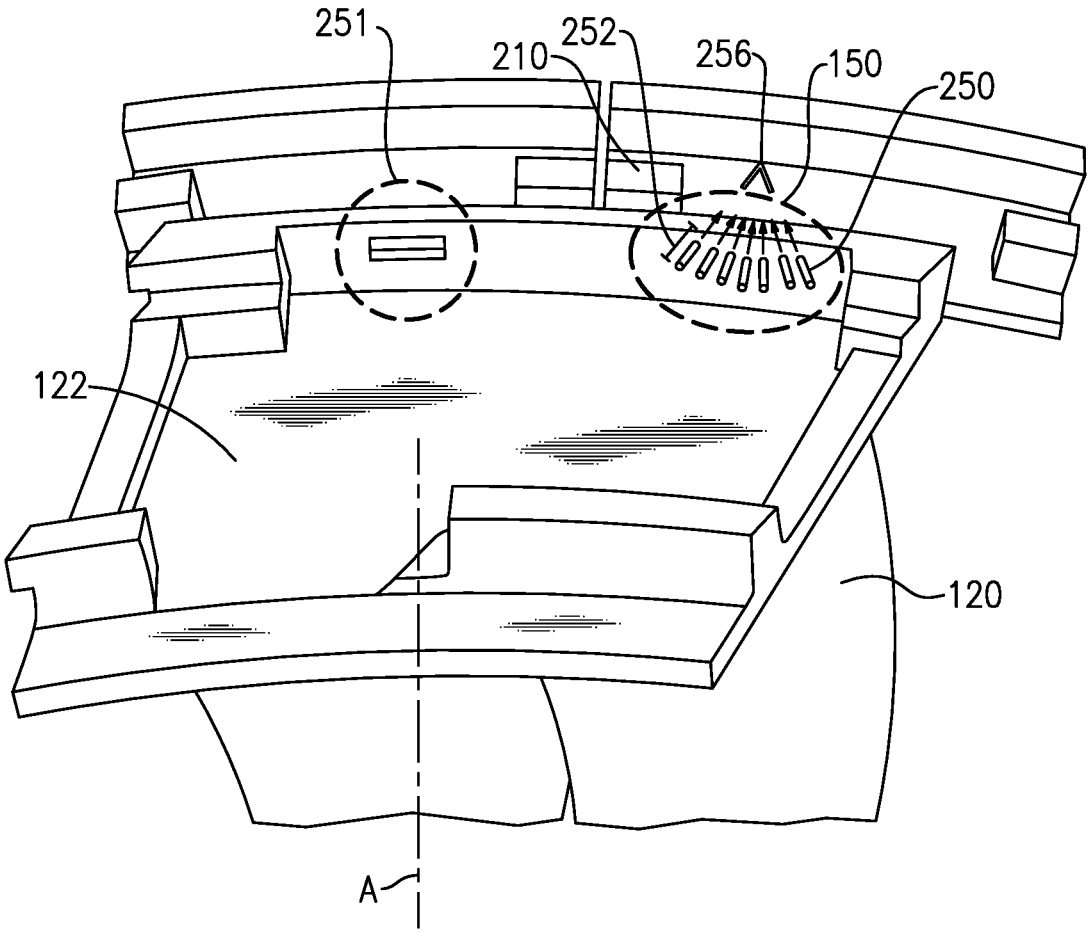
FIG. 3 schematically illustrates a radially outward platform of an exemplary gaspath component.

With continued reference to FIGS. 1 and 2, FIG. 3 schematically illustrates a top view of the vane 120 of FIG. 2 in one example. As described above, the vane 120 includes a plenum 122 into which cooling air is directed. The cooling air passes through openings 150 in a retention hook 210 on one axial side, relative to an axis of the engine 20. In the illustrated example, the cooling air is passed through the downstream retention hook 210 through the openings 150. In addition to the vectored cooling holes 250 making up the opening 150, a portion of the cooling air is passed through a slot 251 as well. The slot 251 does not impart directionality to the air passing through, and is located at a portion of the vane 120 where the directionality is not required.

Each cooling hole 250 in the set of cooling holes is vectored with a length 252 to cross sectional area ratio that is sufficient to impart directionality on the air passing through the retention hook 210. In the example, the holes 250 are oriented such that the cooling air converges at an elevated cooling requirement position 256 in the adjacent component. This configuration is referred to as the holes having converging axis because the axis of the vectored cooling holes converge at a single point. By converging the axis of the cooling holes 250 at a single location, the majority of the cooling provided from the cooling air is targeted to the elevated cooling requirement position 256. In alternative examples, only a subset of the holes 250 include converging axis, and another subset of the holes 250 include aligned axis, or axis that otherwise do not converge.

In yet further alternatives, the cooling slot 251 can be omitted entirely, and all the air is passed to adjacent components through vectored cooling holes 250.

Figure 4A:
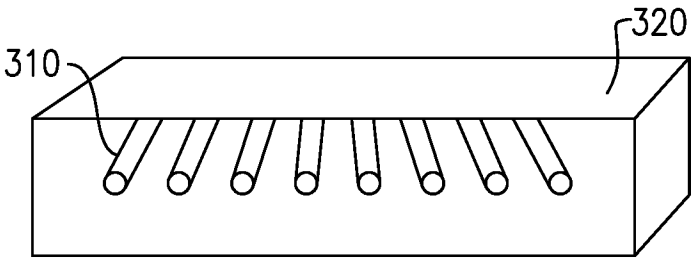
FIG. 4A schematically illustrates a first example vectored hole configuration for the gaspath component of FIG. 3.

With continued reference to FIGS. 1-3, FIGS. 4A-4D illustrate different vectored hole 310 configurations. In the example of FIG. 4A, the vectored holes 310 have a uniform cross sectional area, with a subset of the holes being aligned, and with the holes not sharing a uniform directionality. In such an example, the cooling air can be split, with a portion being directed to a specific location, and a remainder being directed generally toward the adjacent component.

Figure 4B:
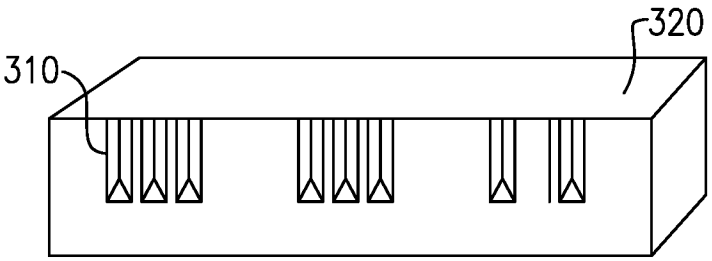
FIG. 4B schematically illustrates a second example vectored hole configuration for the gaspath component of FIG. 3.

FIG. 4B illustrates an example where the holes 310 have a triangular cross sectional area, and the holes 310 are not evenly distributed, but are still arranged in a linear configuration. Alternative cross sectional shapes can be utilized, with the particular cross sectional shape being selected by a designer based on the available practical manufacturing techniques and the specific needs of a given component.

Figure 4C:
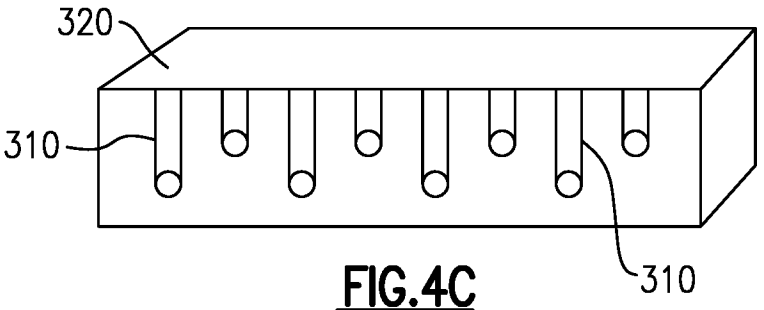
FIG. 4C schematically illustrates a third example vectored hole configuration for the gaspath component of FIG. 3.

FIG. 4C illustrates an example where the hole 310 cross sectional area is uniform across the length of the retaining feature 320, however the holes are positioned at distinct radial heights on the retaining feature 320. Placing the holes in a configuration other than linear allows for further control over the directionality and targeted cooling locations of the adjacent component.

Figure 4D:
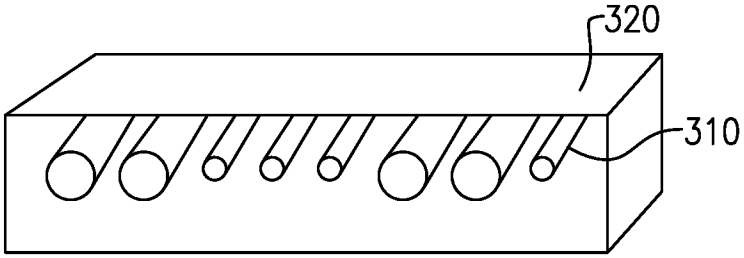
FIG. 4D schematically illustrates a fourth example vectored hole configuration for the gaspath component of FIG. 3.

FIG. 4D illustrates an example where the cross sectional areas of the holes 310 are not uniform, but the holes 310 are aligned in a linear fashion. The utilization of distinct cross sectional areas allows the volume of air targeted at a given location to be more easily controlled, but is constrained by the above described length to cross sectional area ratio required to impart directionality on the airflow.

While illustrated as individual segments, it is appreciated that each of the example configurations of FIGS. 4A-4D could be utilized in combination with each of the other segments either as sub combinations within a single set of vectored cooling holes, or intermixed as a single larger set, or a single vectored cooling hole.

It is further understood that any of the above described concepts can be used alone or in combination with any or all of the other above described concepts. Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A gaspath component comprising:

a platform including a cooling plenum;

at least one retaining feature extending from the platform, the at least one retention feature including at least one retention hook defined by a first wall extending radially outward from the platform and a second wall extending axially from the first wall; and at least one vectored hole disposed in said at least one retention hook and connected to the cooling plenum, wherein the at least one vectored hole includes at least two vectored holes defining converging axes that converge downstream of the at least two vectored holes defining the converging axes relative to an expected flow of fluid through the at least two vectored holes defining the converging axes.

2. The gaspath component of claim 1, wherein all vectored holes in the retention hook define axes converging with axes defined by at least one other vectored cooling hole in the retention hook.

3. The gaspath component of claim 1, wherein the at least one vectored hole includes a plurality of vectored holes and each hole in the plurality of vectored holes is identical to each other hole in the plurality of vectored holes.

4. The gaspath component of claim 1, wherein the at least one vectored hole includes a plurality of vectored holes and each hole in the plurality of vectored holes has an identical cross sectional area.

5. The gaspath component of claim 1, further comprising a vane extending from the platform, and wherein a portion of cooling air received in the cooling plenum is directed to a cooling air flowpath within the vane.

6. The gaspath component of claim 1, wherein the at least one retention hook includes a first retention hook disposed downstream relative to an expected flow direction of an engine including the gaspath component and a second retention hook disposed upstream relative to an expected flow direction of an engine including the gaspath component.

7. The gaspath component of claim 6 wherein each of the first retention hook and the second retention hook include distinct corresponding first walls and second walls.

8. The gaspath component of claim 1, wherein the at least one vectored hole has a length to cross sectional area ratio of at least 2.

9. The gaspath component of claim 1, wherein the at least one vectored hole includes a plurality of vectored holes and each vectored hole in the plurality of vectored holes is arranged in a linear configuration.

10. The gaspath component of claim 1, wherein the at least one vectored hole includes a plurality of vectored holes and the plurality of vectored holes are unevenly distributed.

11. The gaspath component of claim 1, wherein the at least one vectored hole is in the first wall of the retention hook.

12. The gaspath component of claim 1, wherein every vectored cooling hole in the at least one vectored cooling hole is a through hole extending from a first side of the first wall to a second side of the first wall.

13. A method for providing cooling air to a gaspath component comprising:

providing air to a plenum of a first gaspath component;

passing cooling air from the plenum to a second gaspath component axially adjacent the first gaspath component through at least one vectored cooling hole disposed in a retention hook defined by a first wall extending radially outward from a platform and a second wall extending axially from the first wall, the at least one vectored cooling hole imparting directionality on the cooling air, and the at least one vectored hole includes at least two vectored holes defining converging axes that converge downstream of the at least two vectored holes defining the converging axes relative to an expected flow of fluid through the at least two vectored holes defining the converging axes.

14. The method of claim 13, further comprising directing air from at least a portion of the at least one vectored cooling hole to a single location of the second gaspath component.

15. The method of claim 13, wherein passing cooling air from the plenum to the second gaspath component comprises directing the cooling air around at least one of an intervening structure and a front feature of the second gaspath component.

16. The method of claim 13, wherein the first gaspath component is a vane and the second gaspath component is a blade outer air seal.

17. The method of claim 13, wherein the at least one vectored hole includes a plurality of vectored holes and each of the vectored cooling holes in the plurality of vectored cooling holes imparts identical directionality on the cooling air.

18. A gas turbine engine comprising:

a primary flowpath connecting a compressor section, a combustor section and a turbine section;

the turbine section including stage vane having a radially outward platform and a vane extending into the primary flowpath, the platform including a cooling plenum;

at least one retaining feature extending radially outward from the platform, the at least one retention feature including at least one retention hook defined by a first wall extending radially outward from the platform and a second wall extending axially from the first wall; and at least one vectored cooling holes disposed in the at least one retention hook and configured to direct cooling air from the plenum to an adjacent gaspath component wherein the at least one vectored hole includes at least two vectored holes defining converging axes that converge at a single point on the adjacent gaspath component.

19. The gas turbine engine of claim 18, wherein the adjacent gaspath component is a blade outer air seal.

20. The gas turbine engine of claim 18, wherein the at least one vectored hole has a length to cross sectional area ratio of at least 2.

* * * * *